US005669576A

United States Patent [19]

Moody

[11] Patent Number: 5,669,576

[45] Date of Patent: Sep. 23, 1997

[54] APPARATUS FOR SUPPORTING CORELESS ROLLS IN TOILET TISSUE DISPENSER

[75] Inventor: John R. Moody, Antioch, Calif.

[73] Assignee: James River Corporation of Virginia, Richmond, Va.

[21] Appl. No.: 513,438

[22] Filed: Aug. 10, 1995

[51] Int. Cl.[6] ..... B65H 19/00; B65H 16/06; B65H 18/04

[52] U.S. Cl. ..... 242/560.3; 242/599.1; 242/599.3; 242/599.4; 242/578; 242/609; 242/613; 312/34.22

[58] Field of Search ..... 242/599.1, 578.2, 242/599.3, 599.4, 560.3, 578, 613, 609, 118.5; 312/34.22

[56] References Cited

U.S. PATENT DOCUMENTS

| | | | |
|---|---|---|---|
| 720,287 | 2/1903 | Schmidt | 242/55.3 |
| 1,055,576 | 3/1913 | Tyler et al. | 242/560 |
| 1,465,587 | 8/1923 | Mossberg | 242/118.5 |
| 1,665,738 | 4/1928 | Hoegger | 242/598.4 X |
| 1,686,911 | 10/1928 | Fredlund | 242/55.3 |
| 1,890,243 | 12/1932 | Zachert | 242/598 |
| 2,144,070 | 1/1939 | Leinbach | 242/118.5 |
| 2,571,321 | 10/1951 | Wettley | 242/55.2 |
| 2,575,062 | 11/1951 | Merwin | 242/599.3 X |
| 2,603,427 | 7/1952 | Holmes | 242/55.3 |
| 3,010,670 | 11/1961 | Jones et al. | 242/55.3 |
| 3,061,218 | 10/1962 | Moore | 242/55.3 |
| 3,104,847 | 9/1963 | Miller | 242/71.7 |
| 3,279,715 | 10/1966 | Vedvig | 242/55.3 |
| 3,317,099 | 5/1967 | Solomon | 242/593.4 X |
| 3,322,359 | 5/1967 | Dales et al. | 242/68 |
| 3,329,367 | 7/1967 | Paradiso | 242/55.55 |
| 3,593,936 | 7/1971 | Davis | 242/578 |
| 3,612,423 | 10/1971 | Bahnsen | 242/55.42 |
| 3,622,096 | 11/1971 | Young | 242/56.9 |
| 3,690,580 | 9/1972 | Jespersen | 242/55.3 |
| 3,700,181 | 10/1972 | Diring et al. | 242/55.3 |
| 3,771,739 | 11/1973 | Nelson | 242/561 X |
| 4,389,026 | 6/1983 | Willa et al. | 242/55.3 |
| 5,370,336 | 12/1994 | Whittington | 242/560.2 |
| 5,370,339 | 12/1994 | Moody et al. | 242/599.4 X |
| 5,467,938 | 11/1995 | Redman | 242/599.1 |

*Primary Examiner*—John Q. Nguyen
*Attorney, Agent, or Firm*—Thomas R. Lampe

[57] ABSTRACT

A support spindle adapts a toilet tissue dispenser cabinet designed for use with conventional toilet tissue rolls having cores for use with coreless toilet tissue rolls. The support spindle includes a roll stop which is used to position a coreless roll at different locations on a rotatable sleeve incorporated on the support spindle. An insert positioned in the cabinet is employed to prevent premature actuation of a roll drop-down mechanism employed in the cabinet.

15 Claims, 4 Drawing Sheets

APPARATUS FOR SUPPORTING CORELESS ROLLS IN TOILET TISSUE DISPENSER

TECHNICAL FIELD

This invention relates to apparatus for supporting a coreless toilet tissue roll within a toilet tissue dispenser cabinet. More particularly, the invention incorporates a support spindle of specialized construction for insertion into the central aperture of a coreless toilet tissue roll and utilized to support the coreless toilet tissue roll in a toilet tissue dispenser cabinet of the type having opposed, generally vertically oriented, elongated first and second slots communicating with the cabinet interior.

BACKGROUND ART

It is known to manufacture and commercially make available coreless rolls of toilet tissue, i.e. toilet tissue rolls which do not have a central core of paperboard or the like. In coreless toilet tissue rolls the innermost convolution of the toilet tissue web comprising the roll defines a central aperture which is considerably smaller in cross-section than the central aperture or opening of cores utilized in conventional toilet tissue rolls.

A great many dispenser cabinets are in existence which incorporate mechanisms designed and adapted for use with conventional toilet tissue rolls with cores. These include dispenser cabinets for use in public wash rooms and other institutional environs which allow sequential dispensing from a plurality of rolls deployed in the dispenser cabinets.

U.S. Pat. No. 3,771,739, issued Nov. 13, 1973, discloses a toilet tissue dispenser accommodating two rolls of toilet tissue, one above the other. The rolls, which are of the conventional type utilizing a central core of paperboard or other suitable material, are mounted on mandrels which are guided in vertical guide slots, the lower roll being in a dispensing position. A lever engaged by the mandrel of the lower roll holds the upper roll in reserve until the lower roll is depleted. Upon depletion of the lower roll the lever is released. This causes drop down of the upper roll to the lower dispensing position from which paper is manually retrieved from the former reserve roll.

Commercially available toilet tissue dispenser cabinets, such as that described above, are generally not suitable for dispensing toilet tissue from coreless rolls, nor can spindles conventionally employed in such dispenser cabinet constructions be inserted into and utilized to support coreless rolls of toilet tissue.

Although coreless roll spindles are known generally, the present invention incorporates a support spindle of a specific construction which can be utilized in conjunction with a toilet tissue dispenser cabinet of the type identified above to retain a coreless toilet tissue roll in reserve or temporary storage position above the roll actually being dispensed for subsequent drop down and usage. In addition, the support spindle of the present invention can be readily reconfigured to adapt to the requirements of different sizes or types of dispenser as well as to accommodate different web widths.

For certain types of drop-down mechanisms, such as that shown in U.S. Pat. No. 3,771,739 referenced above, premature drop down of a reserve roll can occur before the lower or primary roll is wholly depleted when the rolls are coreless rolls. This is due to the fact that the inner diameter of a coreless roll is significantly less than the inner diameter of a conventional roll wrapped about a core of paperboard or other material. As will be seen below, the present invention also incorporates a feature which will prevent premature drop down of a reserve coreless roll when using cabinets designed for conventional rolls with cores.

Applicant is aware of the existence of the following United States patents which are believed to be representative of the present state of the art in this field: U.S. Pat. No. 1,665,738, issued Apr. 10, 1928, U.S. Pat. No. 1,890,243, issued Dec. 6, 1932, U.S. Pat. No. 3,317,099, issued May 2, 1967, U.S. Pat. No. 5,370,336, issued Dec. 6, 1994, U.S. Pat. No. 2,571,321, issued Oct. 16, 1951, U.S. Pat. No. 3,700,181, issued Oct. 24, 1972, U.S. Pat. No. 1,055,576, issued Mar. 11, 1913, U.S. Pat. No. 3,010,670, issued Nov. 28, 1961, U.S. Pat. No. 4,389,026, issued Jun. 21, 1983, U.S. Pat. No. 3,690,580, issued Sep. 12, 1972, U.S. Pat. No. 3,622,096, issued Nov. 23, 1971, U.S. Pat. No. 3,329,367, issued Jul. 4, 1967, U.S. Pat. No. 3,612,423, issued Oct. 12, 1971, U.S. Pat. No. 3,322,359, issued May 30, 1967, U.S. Pat. No. 3,279,715, issued Oct. 18, 1966, U.S. Pat. No. 3,104,847, issued Sep. 24, 1963, U.S. Pat. No. 3,061,218, issued Oct. 30, 1962, U.S. Pat. No. 2,603,427, issued Jul. 15, 1952, U.S. Pat. No. 1,686,911, issued Oct. 9, 1928, and U.S. Pat. No. 720,287, issued Feb. 10, 1903.

DISCLOSURE OF INVENTION

The present invention relates to a structural combination including a toilet tissue dispenser cabinet, a coreless toilet tissue roll, and a support spindle positioned in the coreless toilet tissue roll supporting the coreless toilet tissue roll in the cabinet interior. The toilet tissue dispenser cabinet includes double-sided, spaced cabinet walls at least partially defining a cabinet interior and further defining opposed, generally vertically oriented, elongated first and second slots communicating with the cabinet interior.

The support spindle of the invention includes an elongated spindle element slidably positionable in the first slot and having a first end and a second end.

Two spaced enlargements are affixed to the elongated spindle element at the first end thereof which are positionable on opposed sides of the cabinet wall defining the first slot.

A second spindle element releasably connected to the elongated spindle element is slidably positionable in the second slot. Two spaced enlargements on the second spindle element are positionable on opposed sides of the cabinet wall defining the second slot.

A rotatable sleeve is rotatably disposed about the elongated spindle element for location within the cabinet interior, the rotatable sleeve having an outer peripheral surface for frictional engagement with the innermost toilet tissue web convolution of the coreless toilet tissue roll.

A roll stop element is in operative association with the elongated spindle element and the rotatable sleeve for engagement by an end of a coreless toilet tissue roll on the rotatable sleeve to positively prevent movement of the coreless paper roll relative to the support spindle and the rotatable sleeve in an axial direction.

An insert having an upwardly oriented coreless toilet tissue roll engagement surface is located within the cabinet interior above the bottom thereof for preventing premature actuation of a reserve roll drop-down mechanism incorporated in the cabinet during depletion of the coreless toilet tissue roll.

Other features, advantages, and objects of the present invention will become apparent with reference to the following description and accompanying drawings.

MODES FOR CARRYING OUT THE INVENTION

Figure 1:
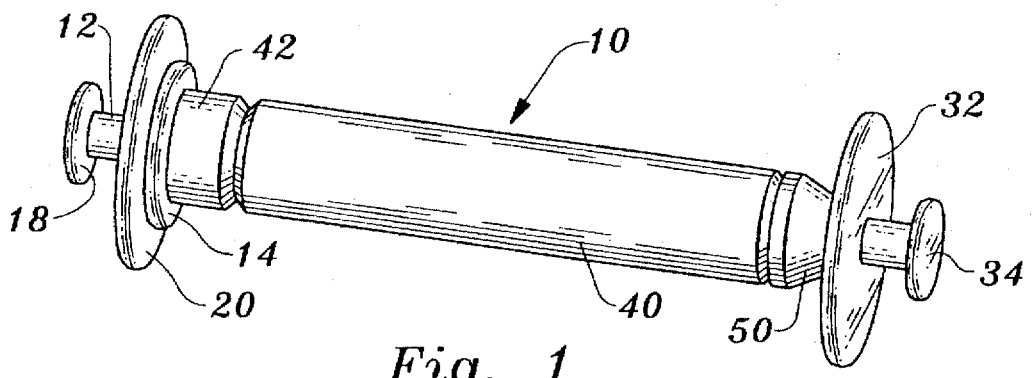
FIG. 1 is a perspective view of a support spindle constructed in accordance with the teachings of the present invention.
Figure 2:
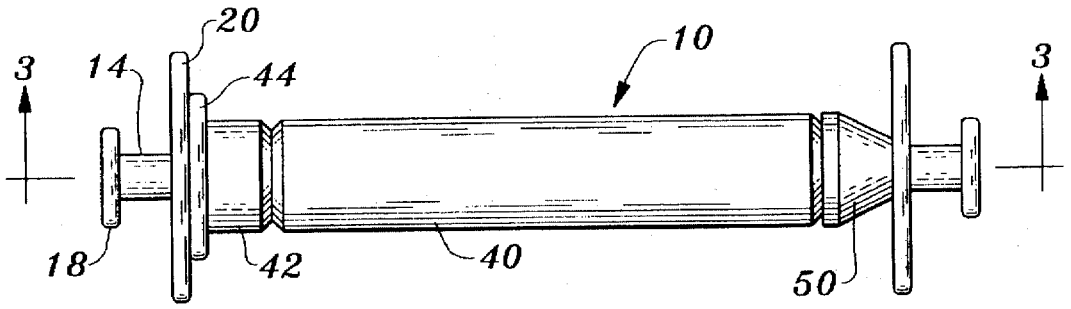
FIG. 2 is a front elevation view of the support spindle of FIG. 1.
Figure 3:
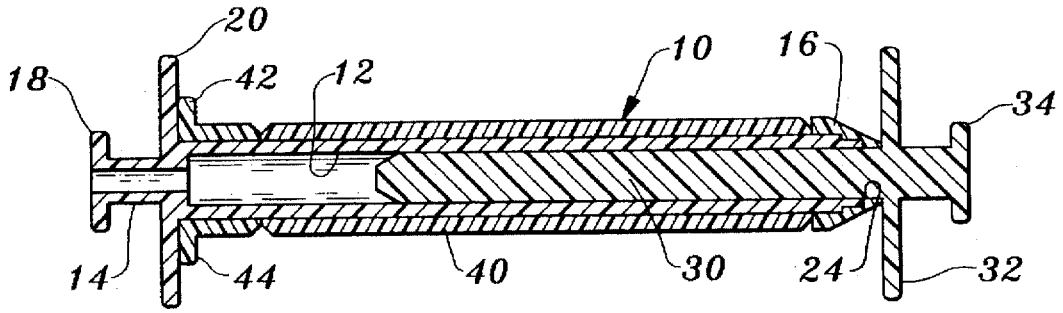
FIG. 3 is a cross-sectional view taken along the line 3—3 in FIG. 2.

Referring now to FIGS. 1–3, a support spindle constructed in accordance with the teachings of the present invention is illustrated, the support spindle being designated by reference numeral 10. Support spindle 10 includes an elongated spindle element 12 which is of hollow construction, having a first end 14 and a second end 16.

Two spaced enlargements 18, 20 are affixed to the first end of the elongated spindle element. Elongated spindle element 12 and the other structural components of the invention which are described below are suitably formed of molded plastic; however, it is to be understood that any other suitable material may be utilized to fabricate the support spindle.

An opening 24 is located at the second end 16 of elongated spindle element 12 which communicates with the elongated spindle element interior. A second spindle element 30 having spaced enlargements 32, 34 thereon passes through opening 24 and is seated within the interior of elongated spindle element 12 and in frictional engagement with the elongated spindle element to resist relative movement therebetween.

A rotatable sleeve 40 is rotatably disposed about the elongated spindle element. Located between sleeve 40 and enlargement 20 is a spacer ring 42 which is rotatable about the elongated spindle element. The circumference of the spacer ring is no greater than the circumference of the rotatable sleeve.

A roll stop element in the form of a flange 44 projects outwardly from and surrounds the spacer ring 42 at one end thereof. In the configuration shown in FIGS. 1–3 the spacer ring is positioned on the elongated spindle element with the flange 44 located at the enlargement 20.

The support spindle 10 also includes a securement member or cap 50 which is connected to the elongated spindle element 12 at the second end thereof. Cap 50 is tapered in a direction away from the rotatable sleeve for facilitating entry of the elongated spindle element and the rotatable sleeve into a coreless toilet tissue roll. The cap 50 defines an opening at its narrow end for receiving the second spindle element 30.

Figure 4:
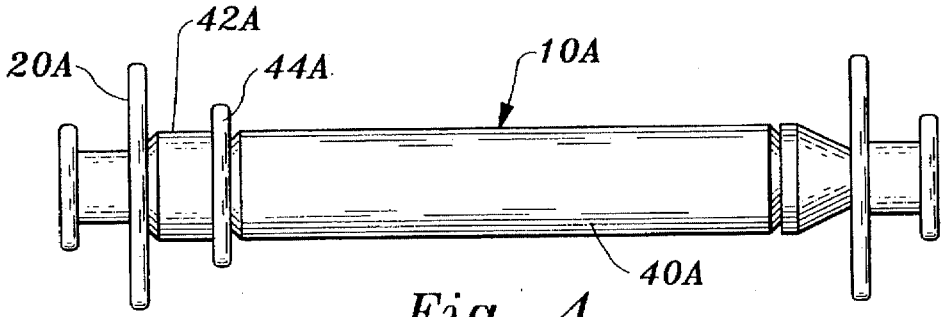
FIG. 4 is a front elevation view of an alternative embodiment of the support spindle.

FIG. 4 shows an alternative embodiment of the support spindle 10A which differs from support spindle 10 in that the dimensions of the structural components thereof are somewhat larger to provide greater strength and stability, support spindle 10A to be utilized in a dispensing cabinet requiring these increased dimensions.

It is to be noted that the spacer ring 42A of support spindle 10A is oriented with the flange 44A thereof located away from enlargement 20A and at the end of rotatable sleeve 40A. It will be appreciated that when the spacer ring is so oriented the flange will serve to stop or terminate axial movement of a coreless paper roll into which the support spindle has been inserted at a location spaced from enlargement 20A rather than at the enlargement. Of course, the spacer ring and flange can be reversed to place the flange 44A at the enlargement 20A to accommodate a roll of greater width or to change the position of the roll relative to the support spindle in accordance with the requirements of the cabinet with which it is to be used.

Figure 5:
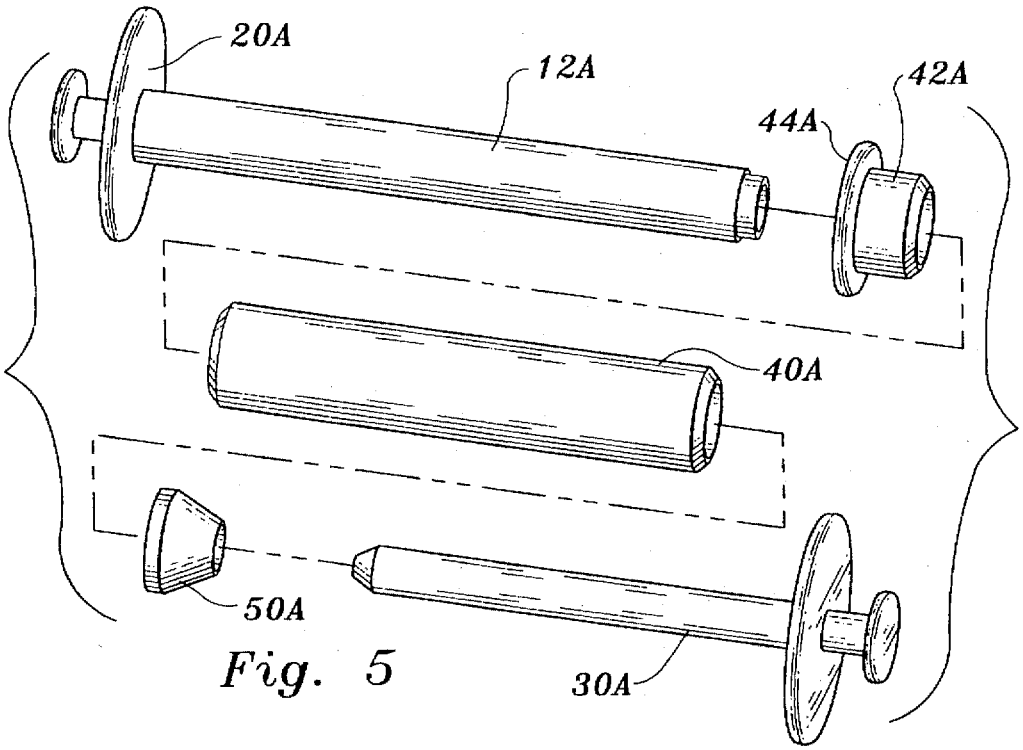
FIG. 5 is an exploded view of the embodiment of the support spindle shown in FIG. 4 but illustrating reversal of one of the elements prior to assembly of the support spindle.
Figure 6:
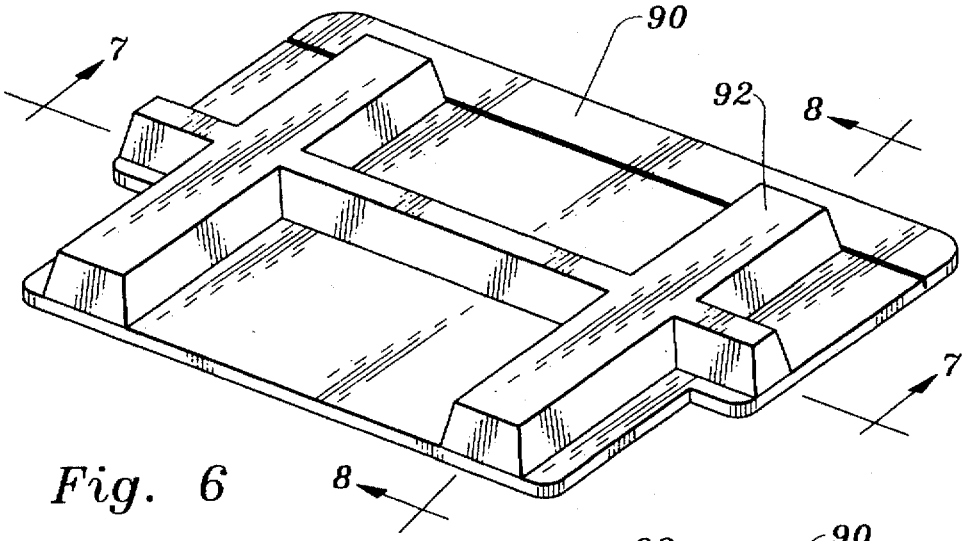
FIG. 6 is a perspective view of an insert for positioning above the bottom of a dispenser cabinet.
Figure 7:
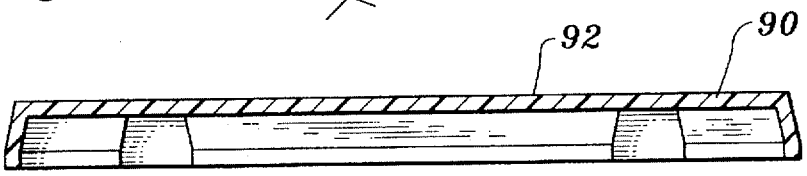
FIG. 7 is a cross-sectional view taken along the line 7—7 of FIG. 6.
Figure 8:
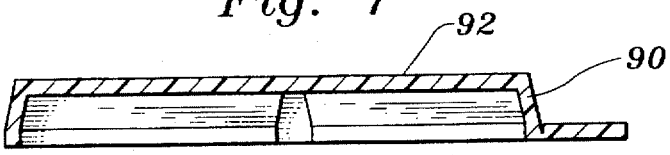
FIG. 8 is a cross-sectional view taken along the line 8—8 of FIG. 6.

FIG. 5 illustrates the support spindle 10A in an exploded configuration with the spacer ring and flange reoriented so that the flange will be located at enlargement 20A upon assembly.

Figure 9:
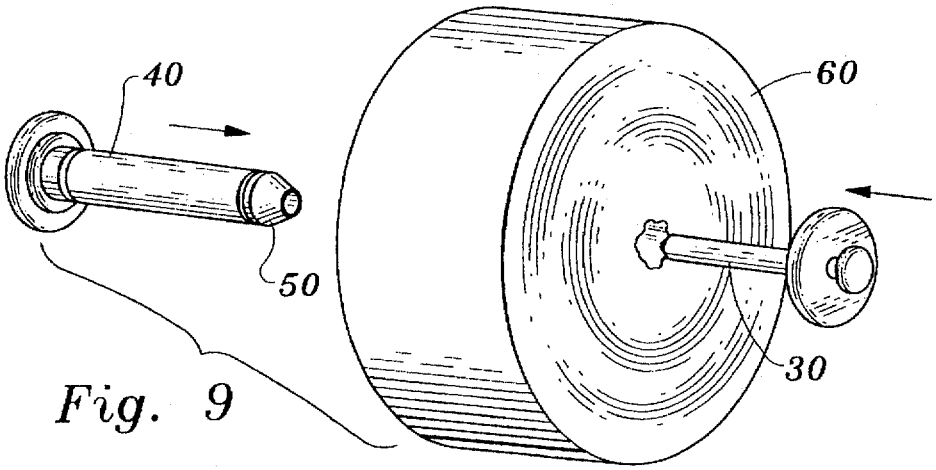
FIG. 9 illustrates a support spindle just prior to insertion thereof into the center of a coreless tissue roll.
Figure 10:
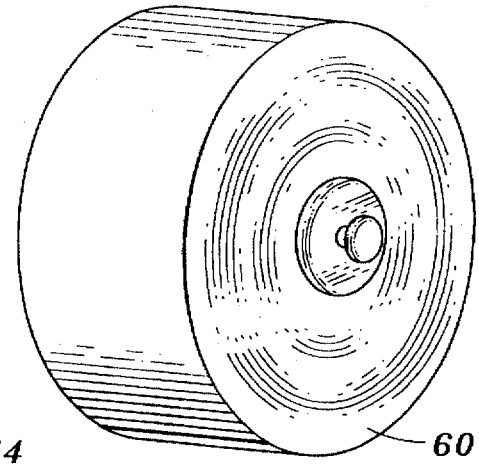
FIG. 10 is a perspective view illustrating a support spindle in the coreless roll.

FIG. 9 illustrates support spindle 10 just prior to insertion thereof into the center of a coreless roll of toilet tissue 60, the center or central aperture of the roll defined by the innermost toilet tissue web convolution. The support spindle illustrated in FIG. 9 is fully assembled except for insertion of the second spindle element 30 into the interior of the elongated spindle element. FIG. 10 shows the roll 60 with the second spindle element fully seated in the elongated spindle element (not shown).

Figure 11:
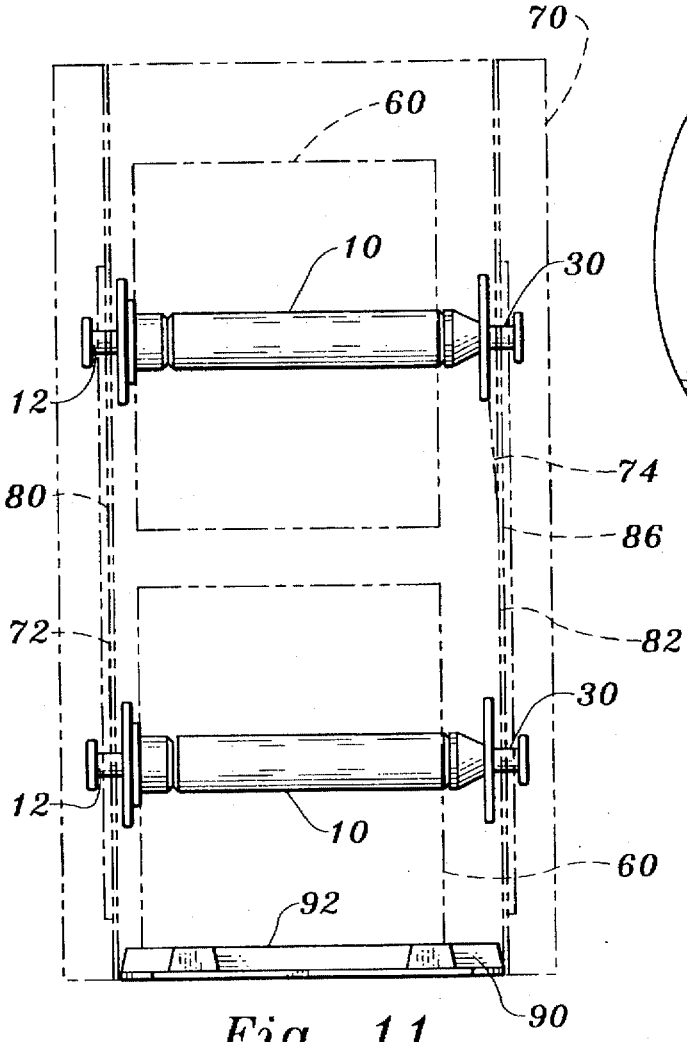
FIG. 11 is an elevation view illustrating two support spindles constructed in accordance with the teachings of the present invention in position in a toilet tissue dispensing cabinet and holding coreless toilet tissue rolls one above the other, the cabinet being illustrated in phantom.
Figure 12:
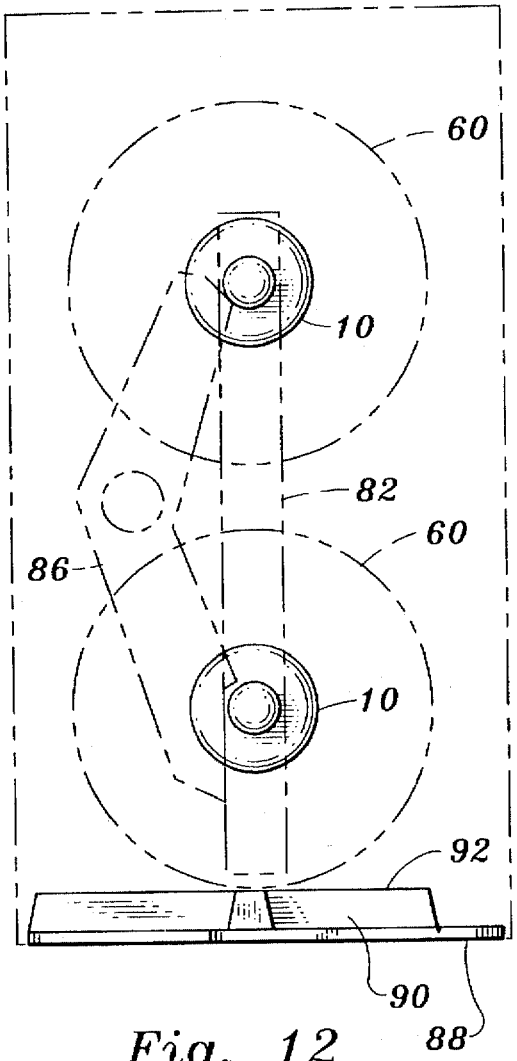
FIG. 12 is a side view illustrating in diagrammatic fashion operation of the drop-down mechanism employed in the dispensing cabinet when two rolls are positioned in the cabinet.
Figure 13:
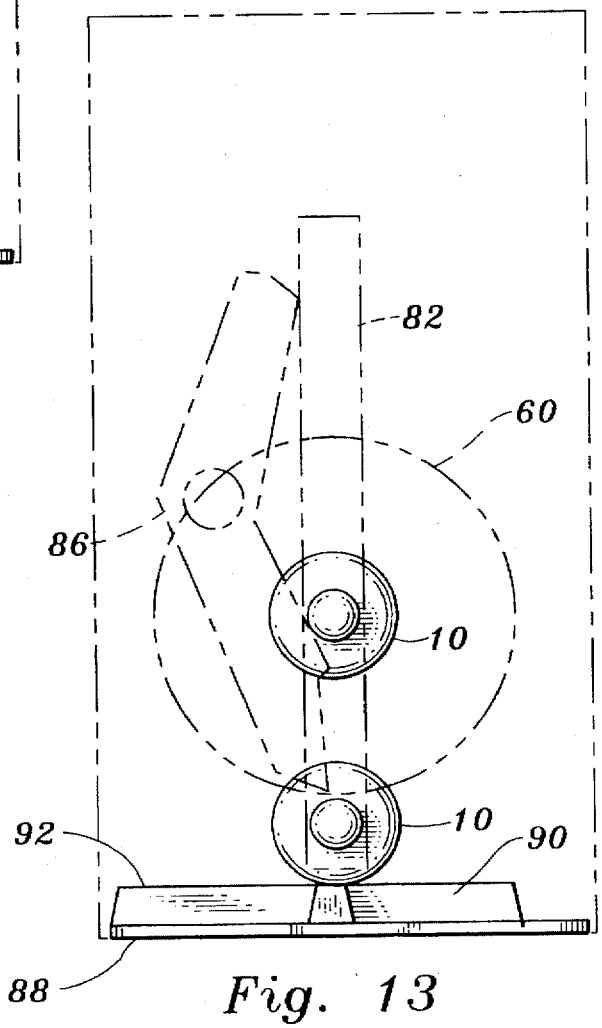
FIG. 13 is a view similar to FIG. 12 but illustrating drop down of a reserve roll upon depletion of the lower or primary roll.

Referring now to FIGS. 11–13, a toilet tissue dispenser cabinet 70 is shown, the cabinet accommodating therein two support spindles 10, each spindle supporting a roll 60. The cabinet may, for example, be the roll paper dispenser disclosed in U.S. Pat. No. 3,771,739, referenced above. Cabinet 70 includes double-sided, spaced cabinet walls 72, 74 at least partially defining the cabinet interior and further defining opposed, vertically oriented, elongated first and second slots 80, 82. Slot 80 slidably accommodates therein the first end of elongated spindle element 12 with the enlargements 18, 20 disposed on opposed sides of the wall 72. Similarly, the second spindle element 30 is slidably positioned in slot 82 with the enlargements of the second spindle element disposed on opposed sides of cabinet wall 74.

Cabinet 70 includes a drop-down mechanism which provides for the drop down to dispensing position at the bottom of the cabinet of the upper reserve roll when the lower or primary roll is depleted. Such mechanism is described in detail in U.S. Pat. No. 3,771,739 and will not be described in detail here. Suffice it to say that such mechanism includes a pivotal lever 86. The lower end of lever 86 engages the lowermost support spindle 10 at slot 82. This engagement keeps the upper end of the lever under an end of the uppermost support spindle 10. Depletion of the lowermost roll 60 and subsequent dropping of the lowermost support spindle 10 out of engagement with the lower end of the lever allows the upper end of the lever to be cammed out of the way under the weight of the uppermost support spindle and roll and drop of the uppermost support spindle and roll from the position shown in FIG. 12 to the position shown in FIG. 13.

Since the cabinet drop-down mechanism was initially designed for use with a conventional toilet tissue roll with core, use of coreless roll product in the cabinet will cause premature drop down of the upper roll. This is due to the fact that the smaller inner diameter of the coreless roll (as compared to a conventional roll with core) will result in disengagement of the lower end of the lever from the lowermost support spindle before all of the tissue has been removed therefrom.

The present invention incorporates structure for solving this problem. It will be appreciated that actuation of drop-down lever 86 is related to the location of the lowermost support spindle to the bottom 88 of the cabinet. The present invention encompasses an insert 90 (FIGS. 6–8 and 11–13) which will maintain the lowermost support spindle 10 at an elevated position relative to the bottom wall 88 until virtually complete depletion of the paper on the lowermost support spindle has taken place.

Insert 90 is in the form of a molded plastic false bottom having an upwardly oriented coreless toilet tissue roll engagement surface 92 located within the cabinet interior above bottom 88. This will prevent the drop-down mechanism from being actuated until the lowermost support spindle 10 engages or closely approaches surface 92.

I claim:

1. In combination:

a toilet tissue dispenser cabinet including double-sided, spaced cabinet walls at least partially defining a cabinet interior and further defining opposed, generally vertically oriented, elongated first and second slots communicating with said cabinet interior;

a coreless toilet tissue roll comprised of a plurality of toilet tissue web convolutions and having a central aperture defined by the innermost toilet tissue web convolution; and a support spindle positioned in the coreless toilet tissue roll supporting said coreless toilet tissue roll in said cabinet interior, said support spindle including an elongated spindle element slidably positioned in said first slot, said elongated spindle element having a first end and a second end, two axially spaced enlargements affixed to said elongated spindle element at the first end thereof and disposed on opposed sides of the cabinet wall defining said first slot, a second spindle element releasably connected to said elongated spindle element and slidably positioned in said second slot, two spaced enlargements on said second spindle element disposed on opposed sides of the cabinet wall defining said second slot, a rotatable sleeve rotatably disposed about said elongated spindle element and located within said cabinet interior, said rotatable sleeve having an outer peripheral surface in frictional engagement with the innermost toilet tissue web convolution of the coreless toilet tissue roll, and a roll stop element in operative association with said elongated spindle element and said rotatable sleeve for abutting engagement by an end of the coreless toilet tissue roll on said rotatable sleeve, said support spindle including a double ended spacer ring surrounding said elongated spindle element, rotatably mounted on said spindle element, and axially located between said rotatable sleeve and the enlargements affixed to said elongated spindle element, said roll stop element comprising a projection secured to and projecting outwardly from said spacer ring at one of the ends of the space ring, said spacer ring and said projection being selectively reversible relative to said elongated spindle element.

2. The combination according to claim 1 wherein said toilet tissue dispenser cabinet additionally includes a bottom, said combination additionally comprising an insert having an upwardly oriented coreless toilet tissue roll engagement and support surface located within said cabinet interior above said bottom.

3. The combination according to claim 1 wherein said elongated spindle element defines a spindle element interior and an opening at the second end thereof in communication with said spindle element interior, said second spindle element extending through said opening and positioned in said spindle element interior.

4. The combination according to claim 3 wherein said elongated spindle element and said second spindle element are in frictional engagement.

5. The combination according to claim 1 wherein said projection comprises a flange extending substantially about said spacer ring.

6. The combination according to claim 1 wherein the circumference of said spacer ring is no greater than the circumference of said rotatable sleeve.

7. The combination according to claim 1 wherein said support spindle includes a securement member secured to said elongated spindle element at the second end of said elongated spindle element, said securement member located between said rotatable sleeve and the enlargements on said second spindle element.

8. The combination according to claim 7 wherein said securement member is tapered in a direction away from said rotatable sleeve.

9. A support spindle for insertion into a toilet tissue dispenser cabinet including double-sided, spaced cabinet walls at least partially defining a cabinet interior and further defining opposed, generally vertically oriented, elongated first and second slots communicating with said cabinet interior and for supporting in said toilet tissue dispenser a coreless toilet tissue roll comprised of a plurality of toilet tissue web convolutions and having a central aperture defined by the innermost toilet tissue web convolution, said support spindle comprising:

an elongated spindle element slidably positionable in said first slot having a first end and a second end;

two spaced enlargements affixed to said elongated spindle element at the first end thereof positionable on opposed sides of the cabinet wall defining said first slot;

a second spindle element releasably connected to said elongated spindle element slidably positionable in said second slot;

two spaced enlargements on said second spindle element positionable on opposed sides of the cabinet wall defining said second slot;

a rotatable sleeve rotatably disposed about said elongated spindle element for location within said cabinet interior, said rotatable sleeve having an outer peripheral surface for frictional engagement with the innermost toilet tissue web convolution of the coreless toilet tissue roll;

a roll stop element in operative association with said elongated spindle element and said rotatable sleeve for engagement by an end of a coreless toilet tissue roll on said rotatable sleeve; and a double ended spacer ring surrounding said elongated spindle element, rotatably mounted on said spindle element, and axially located between said rotatable sleeve and the enlargements affixed to said elongated spindle element, said roll stop element comprising a projection secured to and projecting outwardly from said spacer ring at one of the ends of the spacer ring, said spacer ring and said projection being selectively reversible relative to said elongated spindle element.

10. The support spindle according to claim 9 wherein said support spindle includes a securement member secured to said elongated spindle element at the second end of said elongated spindle element, said securement member axially located between said rotatable sleeve and the enlargements on said second spindle element.

11. The support spindle according to claim 10 wherein said securement member is tapered in a direction away from said rotatable sleeve.

12. The combination according to claim 9 wherein said elongated spindle element defines a spindle element interior and an opening at the second end thereof in communication with said spindle element interior, said second spindle element extending through said opening and positioned in said spindle element interior.

13. The combination according to claim 12 wherein said elongated spindle element and said second spindle element are in frictional engagement.

14. The support spindle according to claim 9 wherein said projection comprises a flange extending substantially about said spacer ring.

15. The support spindle according to claim 9 wherein the circumference of said spacer ring is no greater than the circumference of said rotatable sleeve.

* * * * *